United States Patent [19]

Uke

[11] 4,114,187

[45] Sep. 12, 1978

[54] DIVER'S FLASHLIGHT

[76] Inventor: Alan Kurt Uke, 530 Couper Dr., San Luis Obispo, Calif. 93401

[21] Appl. No.: 739,290

[22] Filed: Nov. 5, 1976

[51] Int. Cl.[2] ..... F21L 11/00

[52] U.S. Cl. ..... 362/158; 200/60; 362/183; 362/203

[58] Field of Search ..... 240/10.6 R, 10.6 CH, 240/10.6 SD, 10.66; 200/60; 362/183, 158, 201, 203

[56] References Cited

U.S. PATENT DOCUMENTS

| | | | |
|---|---|---|---|
| 1,223,883 | 4/1917 | James et al. | 240/10.6 R |
| 3,162,376 | 12/1964 | Furuya | 240/10.66 |
| 3,217,156 | 11/1965 | Sherwood | 240/10.6 R |
| 3,745,287 | 7/1973 | Walker | 200/292 |
| 3,794,825 | 2/1974 | Krupansky | 240/10.6 R |
| 3,796,869 | 3/1974 | Stone | 240/2.25 |
| 3,798,440 | 3/1974 | Brindley | 240/10.66 |
| 3,829,676 | 8/1974 | Nelson et al. | 240/10.6 CH |

*Primary Examiner*—Samuel W. Engle
*Assistant Examiner*—Ralph Palo
*Attorney, Agent, or Firm*—Brown & Martin

[57] ABSTRACT

A diver's flashlight having a unitary case with a closed transparent end for light transmission, the other end being sealed by a threaded plug which also serves as a switch. A halogen bulb is mounted in a reflector immediately inside the transparent end and a rechargable battery is held normally out of contact with the bulb by a spring. Tightening the threaded plug overcomes the spring and completes the circuit when the plug is fully seated in sealed position. The plug, and a cap fitted over the transparent end, are of luminous material for night use.

6 Claims, 6 Drawing Figures

DIVER'S FLASHLIGHT

BACKGROUND OF THE INVENTION

In a flashlight for use underwater, one of the major problems is making the switch watertight. Rubber diaphragms and covers have been used as outer seals and the switch must be operated through the seal. After prolonged use these seals wear and are prone to leakage. Other parts, such as removable ends for replacement of battery and bulb, also must be sealed and servicing the unit often results in damage to or destruction of the seals.

SUMMARY OF THE INVENTION

The diver's flashlight described herein has a cylindrical casing with a single opening at one end, which is closed by a threaded plug with an O-ring seal. The other end has an integral transparent window, inside which is a halogen bulb mounted in a reflector. A rechargable battery pack, slidably contained in the casing is held out of contact with the bulb by a spring. To turn the flashlight on, the threaded plug is screwed in to the fully seated position, which pushes the battery against the spring and into contact with the bulb. When the plug is unscrewed to a partially withdrawn, but still sealed position, the spring pushes the battery out of contact. Thus no actual switch is required and the sealing problem is eliminated.

The casing is made of tough plastic material to withstand rough usage and is preferably transparent to show the interior condition of the flashlight, as for detecting a leak. To facilitate use at night, the threaded plug, and a cap fitted over the transparent closed end are made from luminous material for visibility when the flahslight is turned off. As long as the easily replaceable O-ring seal is in good condition, the flashlight is capable of withstanding water pressure at any depth encountered in normal scuba diving.

The primary object of this invention, therefore, is to provide a new and improved diver's flashlight.

Another object of this invention is to provide a diver's flashlight having a single opening in one end, which is sealed by a removable plug.

Another object of this invention is to provide a diver's flashlight in which the sealing plug is threaded and acts as a switch by screwing the plug in and out, while maintaining a seal.

A further object of this invention is to provide a diver's flashlight having luminous portions for visibility in the dark.

Other objects and advantages will be apparent in the following detailed description, taken in conjunction with the accompanying drawing, in which.

DESCRIPTION OF THE PREFERRED EMVBODIMENT

Figure 1:
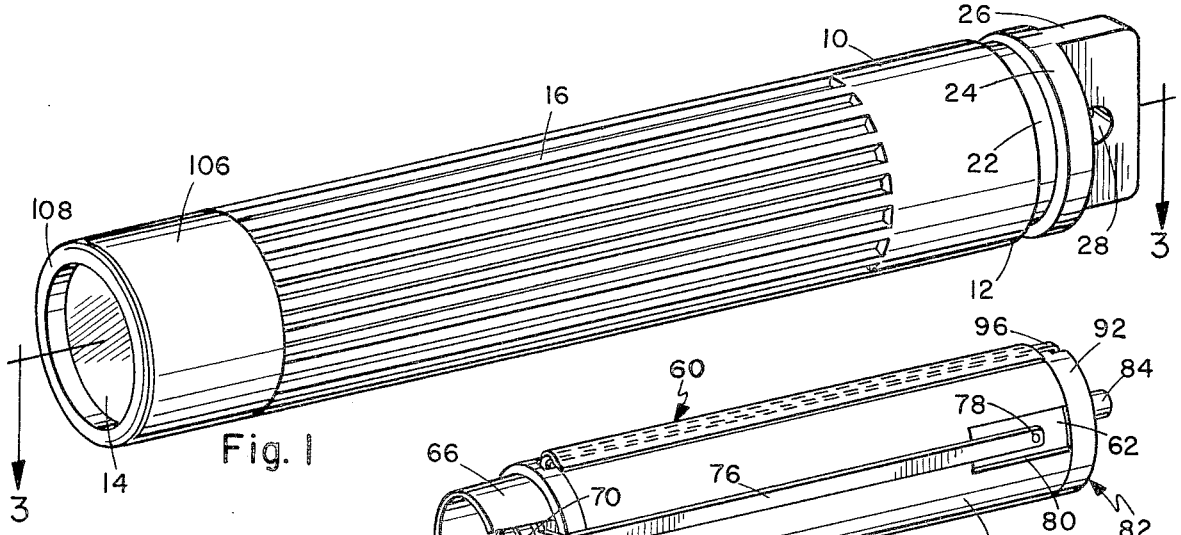
FIG. 1 is a perspective view of the flashlight.

The flashlight has an elongated cylindrical casing 10 with an open end 12 and a closed transparent end of window 14. The casing 10 is illustrated as having longitudinal ribs 16 to provide a good gripping surface, and is preferably completely transparent to permit internal inspection while in use. To withstand pressure and rought usage, the casing is preferably made in one piece from a tough plastic material, such as LEXAN or the like.

Open end 12 has internal screw threads 18 inset from the end, leaving a smooth undercut bore 20 opening to the end. The open end is closed by a threaded plug 22 which screws into threads 18. Plug 22 has a radially extending flange 24 and a longitudinally projecting lug 26 with a hole 28, for attachment to a retaining cord or strap, not shown. The plug is sealed by an O-ring 30 seated in an annular groove 32 in the plug, the O-ring sealing against the smooth bore 20.

Inside the casing 10 against window 14 is a lamp unit 34, comprising a cylindrical block 36 of plastic material with a reflectively coated cavity 38, of parabolic or similar configuration. Block 36 has an axial bore 40, in which a bulb 42 is positioned in focal relationship to the reflector cavity 38. As illustrated, the bulb 42 is a halogen type for maximum brightness and has a pair of connecting wires 44 and 46. One wire 44 is locked by and connected to a conductive post 48 press fitted into bore 40 and projecting from the back face 50 of block 36. The other wire 46 extends to a slot 52 spaced from bore 40, and is located in place by a conductive tongue 54 pressed into the slot. The tongue 54 extends from a conductive ring 56 coaxial with post 48. An insulating sleeve 58 is fitted over part of post 48 to prevent contact with ring 56.

Figure 2:
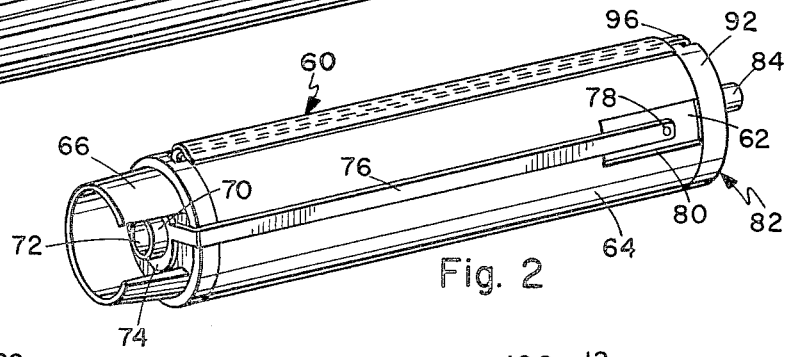
FIG. 2 is a perspective view of the rechargable battery pack.
Figure 3:
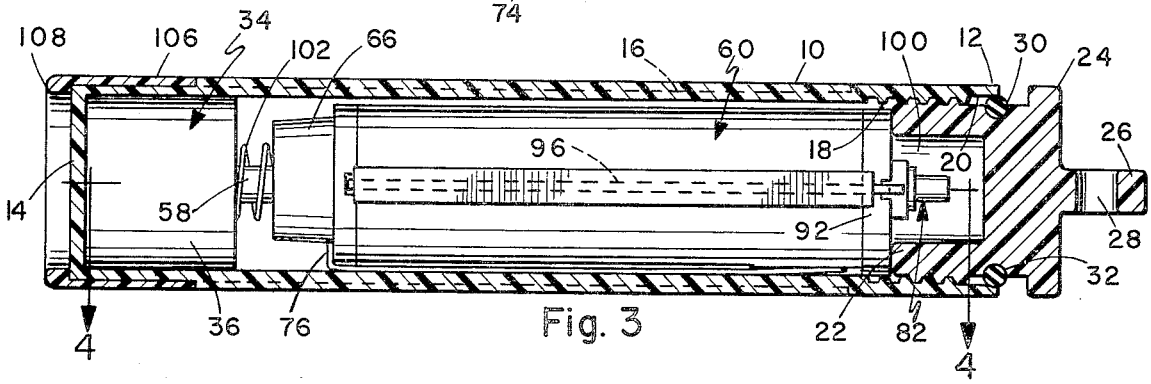
FIG. 3 is a sectional view taken on line 3—3 of FIG. 1.
Figure 4:
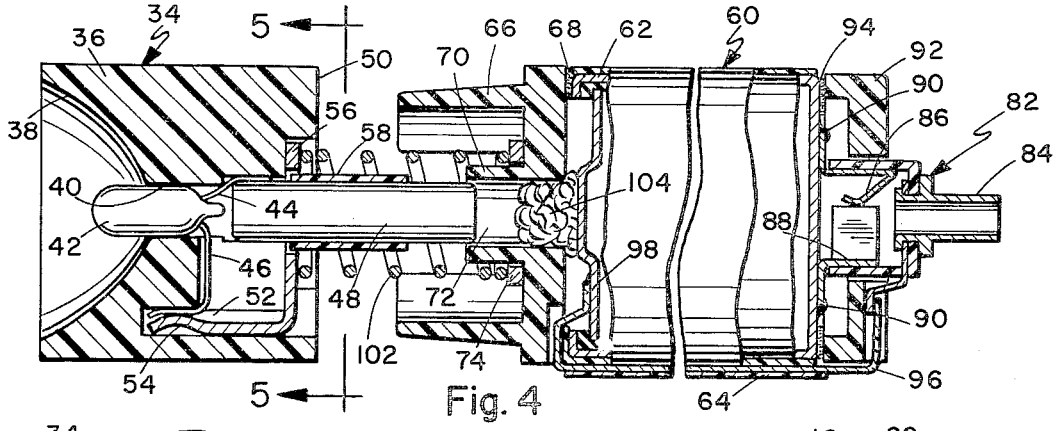
FIG. 4 is an enlarged sectional view of the electrical assembly as taken on line 4—4 of FIG. 3.
Figure 5:
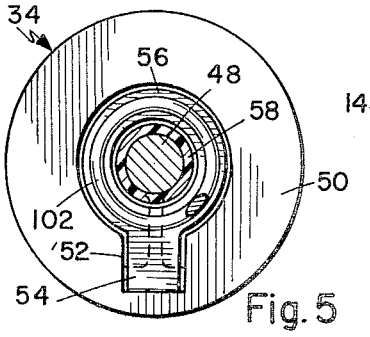
FIG. 5 is a sectional view taken on line 5—5 of FIG. 4.

The battery pack 60, illustrated in detail in FIGS. 2 and 4, includes a suitable number of rechargable batteries 62 connected together in the usual manner and enclosed in an insulated jacket 64. On one end, the positive end as shown, in a substantially cylindrical cup 66, secured to the battery pack by adhesive 68, or other suitable means. Inset in the cup 66 is an axial boss 70 having an axial bore 72 to receive post 48. Around the base of boss 70 is a contact ring 74, from which a connector strip 76 extends to the other end of the battery pack and is connected to the side wall or negative terminal 78. The connection is made through an opening 80 in jacket 64, as in FIG. 2.

On the other end of the battery pack is a charging jack 82, having a conductive sleeve 84 to receive the plug of a charger, not shown. Inside the jack are contacts 86 and 88 which are connected to the negative end of the battery by welds 90. The switching function of the type of jack shown is not required, but the dual contacts provide a stable connection to the battery. The connections are covered by a cap 92, which is a part of the jack assembly and is secured to the battery pack by adhesive 94, or the like. A connector strip 96 is connected from sleeve 84, along the side of the battery pack and under cup 66 to the positive end contact 98. Plug 22 has an internal socket 100 to provide clearance for the sleeve 84, the plug bearing on cap 92 to hold the battery pack.

When the flashlight is assembled, the tip of post 48 fits into bore 72 of the battery pack. A compression spring 102 forces the battery pack 60 away from the lamp unit 34, the spring seating on contact rings 56 and 74 to make an electrical connection. One end of the spring 102 fits over and is centered by boss 70, the other end being concentric with post 48 but insulated therefrom by sleeve 58.

Figure 6:
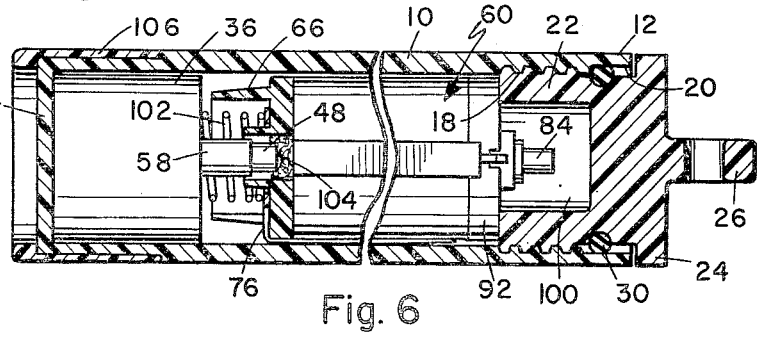
FIG. 6 is a sectional view similar to FIG. 3, showing the flashlight in the on position.

In the off position, the plug 22 is screwed just far enough into the casing 10 so that O-ring 30 is sealed against bore 20. Thus the flashlight is watertight when off. To turn the flashlight on, the plug 22 is screwed all the way into the casing, forcing the battery pack against spring 102 and driving post 48 into bore 72, as in FIG. 6. To ensure good electrical contact of post 48 with the positive end of the battery pack, a compressible conductor pad 104 is placed in bore 72. It has been found that steel wool is particularly suitable for this purpose, and will provide contact over a small range of travel which will accommodate any assembly and alignment tolerances in the structure. When properly packed in place between the battery and cup 66, the steel wool will hold its position and not come loose to make improper connection in the off position. If necessary the conductor pad can be soldered or otherwise secured to the battery.

A cylindrical plastic cap 106 is fixed on the closed end of casing 10, the cap having an extended annular rim 108 which protects window 14. To aid in locating the flashlight in the dark, cap 106 and plug 22 are made luminous by suitable phosphorescent material, coated on or impregnated into the plastic.

With no metal parts exposed to moisture, the flashlight is not susceptible to corrosion. The only opening into the casing is sealed by an O-ring which is easily replaced when necessary. By using a transparent casing, the O-ring can be inspected at any time and leaks can be quickly detected.

While primarily intended for use by divers, the flashlight is also ideal for spelunking, camping, or any other use requiring a compact, high power, waterproof light source is needed. The structure is easily disassembled for servicing and all parts are readily replaceable.

Having described my invention, I now claim:

1. A diver's flashlight comprising:

an elongated, substantially cylindrical transparent casing having an open end and a closed transparent window end, a reflector in said casing at said window end and having a bulb mounted in focal relation therein, battery pack means for being positioned in said casing and having contact means for circuit completing contact with said bulb, a spring separating said battery pack from physical contact with said bulb, said open end of the casing having screw threads therein, threaded plug means for being engaged in said screw threads and abutting said battery pack to drive the battery pack against said spring when the plug means is screwed into the casing, an O-ring on said plug, and said screw threads being inset and said casing having a smooth internal hole at the open end thereof, against which said O-ring seals.

2. A diver's flashlight according to claim 1, wherein said battery pack has a charging jack secured on the end abutted by said plug, the plug having a socket to receive the charging jack.

3. A diver's flashlight according to claim 1, and including a protective cap on said window end, said cap and said plug being luminous.

4. A diver's flashlight according to claim 1, wherein:

said contact means includes a cup fixed on the end of said battery pack adjacent said reflector, said cup having an axial bore with a contact therein connected to one terminal of the battery pack, a conductive post connected to one terminal of said bulb and projecting from said reflector to enter said axial bore, a first contact ring on said reflector, concentric with and insulated from said post, said first contact ring being connected to the other terminal of said bulb;

a second contact ring in said cup concentric with said axial bore and connected to the other terminal of said battery pack, said spring extending between and electrically interconnecting said contact rings, and an insulating sleeve electrically separating said conductive post and said spring.

5. A diver's flashlight according to claim 4, wherein the contact in said axial bore is of compressible conductive material.

6. A diver's flashlight according to claim 4, wherein said reflector comprises a block of insulative material having a reflective cavity therein, and an axial bore therethrough in which said bulb is mounted, said bulb having a pair of connecting wires extending therefrom;

said conductive post being tightly fitted into said last mentioned axial bore and securing one of said wires therein;

a socket spaced from said post and a conductive tongue fitted tightly into said socket and holding the other of said wires therein;

said tongue being connected to said first contact ring.

* * * * *